United States Patent [19]

Stuhr

[11] 4,077,305

[45] Mar. 7, 1978

[54] HYDRAULIC PISTON MOTOR

[75] Inventor: Hans Waldemar Stuhr, Aschaffenburg, Germany

[73] Assignee: Linde Aktiengesellschaft, Wiesbaden, Germany

[21] Appl. No.: 709,907

[22] Filed: Jul. 29, 1976

[30] Foreign Application Priority Data

Aug. 2, 1975 Germany ..... 2534688

[51] Int. Cl.[2] ..... F01B 13/04

[52] U.S. Cl. ..... 91/486

[58] Field of Search ..... 74/60; 91/486–489, 91/499; 417/270, 269

[56] References Cited

U.S. PATENT DOCUMENTS

| | | | |
|---|---|---|---|
| 2,455,330 | 11/1948 | Dennison, Jr. | 91/486 |
| 2,847,938 | 8/1958 | Gondek | 91/488 |
| 3,208,395 | 9/1965 | Budzich | 91/489 |
| 3,257,960 | 6/1966 | Neel | 91/486 |
| 3,726,609 | 4/1973 | Cattanach | 417/270 |
| 3,996,806 | 12/1976 | Alexander | 74/60 |

FOREIGN PATENT DOCUMENTS

| | | | |
|---|---|---|---|
| 2,100,028 | 10/1971 | Germany | 91/486 |
| 791,992 | 3/1958 | United Kingdom | 91/499 |

*Primary Examiner*—William L. Freeh
*Attorney, Agent, or Firm*—Karl F. Ross

[57] ABSTRACT

A hydraulic piston motor, preferably a hydrostatic motor of the axial-piston type, has its pistons hydrostatically urged against a surface which is moved relative to or with the pistons in order to reduce static frictional retardation of the pistons upon starting the motor.

17 Claims, 5 Drawing Figures

HYDRAULIC PISTON MOTOR

FIELD OF THE INVENTION

The present invention relates to a hydraulic piston motor and, more particularly, to an axial-piston motor in which one or more pistons bear against an inclined surface and are received in cylinders which are hydraulically pressurized to rotate a cylinder drum and thereby drive the motor shaft. More specifically, the invention relates to improvements in the starting of such motors.

BACKGROUND OF THE INVENTION

Hydraulic motors of the piston-type, e.g. axial-piston motors, may have one or more pistons received in a cylinder drum in respective cylinders which are hydraulically pressurized to press the pistons against an inclined surface. The surface may rotate with a shaft and thus can be termed a drive flange or can be fixed, the shaft being connected to the drum so that the reaction forces rotate the latter.

In both such motors, frictional retardation between the piston and the wall of the cylinder develop during operation (sliding friction) and exist before the rotation commences (static friction).

In motors having an inclined surface it has been common practice to provide a fluid cushion between a shoe at the head of the piston and connected thereto by a ball joint, the cushion being supplied with hydraulic fluid which is also passed into the ball joint. The fluid acts as a friction-reducing medium by forming a pressure film and as a lubricant.

During rotation of the drum, the engagement of the shoe with the inclined surface is practically frictionless because of the pressurized cushion although, before rotation begins and even after the cylinders of the drum have been pressurized, there is a static friction because the lubricating film has not been fully formed.

Because the static friction is substantially higher than the sliding friction encountered during rotation of the shaft and normal operations of the motor, initially a substantially higher torque must be developed to "break loose" the motor and begin its rotation. If the motor is dimensioned to deliver its maximum operating torque at a particular fluid pressure, this pressure is frequently not sufficient to break loose the latter moving parts of the motor against the retardation of the static friction, especially since static friction is often proportional to applied pressure. Consequently, the motor must be over-"dimensioned" i.e. dimensioned to deliver a higher torque than is normally required during its operation, for starting purposes, or simply may not be self-starting with the application of pressure.

The problem is especially pronounced in sliding-shoe motors in which the inclined surface is angularly fixed, because the initial pressurization of the cylinders applies the shoe with considerable force against the surface engaged thereby with static friction.

While the pressure cushion between the shoe and the inclined surface does tend to reduce the static friction, the problem nevertheless remains and friction between the piston and the cylinder wall is not reduced by such pressurization.

It has been proposed to couple the motor with the load by a clutch so that the starting torque can be applied without loading. This system has the disadvantage that additional elements are required in the drive train.

None of the solutions to the problem of starting a hydraulic motor against the static friction forces heretofore have proved to be fully satisfactory.

OBJECTS OF THE INVENTION

It is the principal object of the present invention to provide an improved system for starting a hydraulic piston motor and especially an axial-piston motor.

Still another object of this invention is to provide a hydraulic piston motor system, especially an axial-piston motor system which can be more readily started from standstill, without the need for overdimensioning the motor, i.e. without providing a motor whose torque output exceeds the maximum required for normal running operations.

Another object is to obviate the aforementioned drawbacks.

SUMMARY OF THE INVENTION

These objects and others which will become apparent hereinafter are attained, in accordance with the present invention, in a hydraulic piston motor comprising at least one piston bearing against an inclined surface and received in a cylinder which is pressurizable, wherein, upon pressurization of the cylinder to start the motor, a slight relative movement is imparted to the inclined surface to break loose the static frictionally interacting surfaces.

Preferably the slight movement is imparted automatically although it can be imparted under the control of the motor operator. A device is provided in the motor system which, upon application of fluid to the piston before starting of the motor, imparts relative movement to the piston and/or a surface against which the piston bears with the piston force, namely, the inclined surface.

At least one component of this relative movement should be in the direction of the piston axis, i.e. parallel to the axes of the pistons and their drum so that a relative movement is imparted to the pistons and the cylinder wall juxtaposed therewith, thereby transforming the static friction between the two into a dynamic or sliding friction. At least one component of the relative movement can, however, also be applied tangentially to the circular path of the piston along the piston-guide plane, i.e. the inclined surface.

With hydrostatic axial-piston motors of the inclined-disk type wherein an inclined disk is fixed to the motor housing and forms the inclined surface relative to which the pistons move and the drum rotates, it is preferred to effect the relative movement by imparting a small movement to this disk in the axial direction.

To this end, behind this inclined disk or body I can temporarily provide a pressurized compartment which can apply a force which is greater than the total force applied by the pistons to this inclined surface which acts upon the opposite side of the inclined disk so that inclined disk moves slightly against the piston force and thereby shifts the pistons slightly relative to the respective cylinder walls. This movement can continue until the inclined disk unblocks a discharge opening of the compartment through which the hydraulic fluid can be discharged. According to a feature of the invention, the discharged hydraulic fluid operates a valve which prevents further entry of the fluid medium into this compartment.

The briefly generated axial displacement of the inclined disk breaks the static friction between the pistons and the respective cylinder walls and, as a result of the discharge of fluid from the compartment, the inclined disk can move back rapidly to receive slightly from the sliding shoes of the pistons and thereby break the static friction between the latter and the inclined surface. Furthermore, this slight recession permits the fluid medium to pass between the inclined surface and the surfaces of the shoe bordering the pressure cushions to ensure full lubrication immediately upon starting. The recessional movement can be produced hydraulically or by a spring.

The sudden reverse movement of the body formed with the inclined surface can be effected by releasing the pressure behind it and causing it to move rearwardly at a rate faster than the rate at which the pistons are driven toward it by the hydraulic pressurization of their respective cylinders. The higher rate of movement of this body can be effected by the aforementioned spring or by another force acting in the direction of the piston force but applied to the body independently thereof.

For axial piston motors having inclined-disk configurations and adjustable stroke, wherein the inclined disk is mounted on a rocker which is displaceable upon an axis perpendicular to the axis of the cylinder drum, the movement to break loose the pistons can be effected by providing the rocker with a pressurizable compartment directly and mounting the inclined surface so as to be movable relative to the rocker upon the application of pressure to or its release from this compartment. This arrangement is similar to the arrangement described above in which a substantially angularly fixed body carries the inclined surface.

Alternatively, the pressurizable compartment may act upon the rocker itself. For example, the compartment may act on one side of a swingable plate which forms the rocker directly (see application Ser. No. 625,096 filed Oct. 23, 1975 now U.S. Pat. No. 4,026,195). The pressure compartments assigned to displace this pivotal member can be briefly energized hydraulically simultaneously or one of the compartments can be supplied with a slightly higher pressure than the other to impart an axial displacement to the disk and thereby effect the relative movement of the pistons and the cylinder walls associated therewith.

If pressure compartments for hydrostatic relief (i.e. support) of the rocker are provided, a higher pressure can be supplied to these compartments than is normally developed by the application of the drive pressure to the motor to produce the small movements required to break loose the pistons. In either case the movement of the rocker is effected only briefly.

It is also possible, according to the invention, to break loose the pistons by briefly applying a small angular displacement to the rocker about its pivot axis, i.e. in the normal sense of tilting thereof for speed adjustment. Preferably this brief displacement is in the direction of a greater angle between the inclined disk and the axis of the cylinder drum. This small movement can be applied, and thereafter followed by a return of the rocker to its normal position for the particular load being driven, i.e. when the angle does not correspond originally to the maximum or a starting phase of operation allowing a greater angle is permitted.

According to one aspect of the invention, one or more pressure compartments can be pressurized to produce the aforementioned small axial displacement and simultaneously the walls of the compartment which is axially displaced can form part of a hydrostatic bearing for this member if it is rotatable. This has been found to be important in driving-flange machines. In driving-flange machines in which the drive flange is journaled in ball bearings, the friction on the piston walls during starting can be reduced by a slight displacement of the cylinder drum with respect to the pistons. This has the advantage that complex hydraulic means for axially displacing the drive flange, when the latter is roller-bearing mounted, is unnecessary. For example, the cylinder drum normally rides on a control face from which hydraulic fluid is admitted to the successive cylinder bores, the control face being provided usually by a valve plate against which the cylinder drum end rides. If this cylinder is briefly lifted from the control face the fluid passing through the ports of the control face can leak between the sealing surfaces and the latter and the drum. If this is a disadvantage, it is possible to provide hydraulic means for displacing the valve plate and the cylinder drum axially simultaneously.

According to a feature of the invention, the hydraulic fluid flow to the pressurizable compartments for displacing the movable member axially can be effected through the pressure cushions in the sliding shoes of the pistons which normally lie in contact with the inclined surface. This relationship between the pistons of the surface can thus be used to supply the hydraulic fluid for charging the respective compartments. The supply of hydraulic fluid can be terminated during a normal operation or the communication of fluid through the pistons otherwise used, e.g. to distribute a lubricant.

There are, of course, in existence pivotal disk controls for a hydrostatic motor in which the pivotal disk forms the valve plate distributing fluid to the cylinder drum. In this case, the control surface can be tilted relative to the axis of the drum so that the dead point position of the pistons is shifted. It has been found that this reduces noise. In such an axial piston motor it is advantageous to provide the relative movement in the form of a torque in the direction of rotation, e.g. with an additional piston, the break-loose movement being applied in a direction tending to force a piston under pressure out of its respective cylinder.

In all cases it has been found to be advantageous to keep the relative movement of the piston and the cylinder walls inducted to break the static friction very small and of the order of the amplitude of a vibrational reciprocation. In the present case, however, the displacement is effected hydraulically although electrochemical or other devices may be used to generate a vibration having an equivalent effect. For example, a vibrating valve can be provided in the line connected to the pressurizable compartment of the motor to which the vibration can most advantageously be applied will of course depend upon the particular structure of the motor.

The advantage of the described systems is that the hydraulic motor can be supplied with the necessary fluid pressure to drive it for a given load, while the motor is under this load, and can be started directly under these driving conditions. It is not necessary to first cause the motor to operate at a substantially lower loading, to delay coupling the motor to the load, or to apply significantly higher starting pressure. As a result the maximum pressure which is to be used to operate the motor can be applied with assurance that the motor will start and without the need for overdimensioning the motor so as to accommodate higher pressures than the maximum operating pressure.

In all of the embodiments described, a hydraulic pulse is applied to the motor system so as to shift the pistons to a slight extent with respect to the walls against which they act with static friction.

It has been found to be advantageous to provide the control means for generating this additional movement with means responsive to the motion of the output shaft of the motor. For example, should the application of the starting and operating pressure immediately cause the shaft to turn, there is no need to trigger the application for the means for producing the slight additional movement described above. Thus I prefer to employ a means for detecting rotation of the shaft for automatically deactivating the additional-motion means when the shaft begins rotating or holding the latter in an inoperative condition in the event the motor begins rotating immediately upon application of the drive pressure. This eliminates the need for a subjective response, which may be delayed, on the part of an operator. The control element of the system may be a valve, electromagnet or vibration device which is turned off or on by the rotation detector.

According to a further feature of the invention, therefore, the apparatus comprises means effective upon standstill of the shaft of the hydraulic motor for imparting a break-loose movement thereto when the motor is supplied with its full operating pressure and means responsive to the rotation of the shaft for enabling or inactivating the movement-producing means.

The rotation sensor can act directly upon the shaft under hydraulic pressure which is relieved when the shaft begins to rotate.

The sensor according to the invention can comprise a pin which lies precisely along a radius of the shaft axis and is hinged to a piston for pivotal movement about an axis parallel to the shaft axis and therefore coplanar therewith. When the piston is pressurized to urge the pin into contact with the shaft, the piston is immobilized by the shaft in a nonrotating condition of the latter. However, when the shaft begins rotating, the pin is deflected in the direction of rotation and the piston is free to advance because of the articulation between the pin and the piston rod, the piston movement being detected to signal the rotation of the shaft. It should be noted that this detection can be effected by a pressure responsive device which senses the buildup of pressure behind the piston so that, when the piston advances, the pressure behind it drops and the pressure drop is used to control the application of the break-loose movement to the hydraulic motor. Alternatively, the piston movement may unblock a passage allowing the fluid behind the piston to drain, whereby either the pressure in the drain line or the drop in pressure in the supply line can be used to signal the rotation of the shaft.

Of course, a rotation sensor can be eliminated when a torque sensor is used. Thus, when the shaft is not rotating because of static friction, there is no torque generated between it and the load although there is a buildup of the pressure in the hydraulic motor to the operating pressure. A static frictional retardation of the piston, moreover, prevents torque from being generated at the cylinder drum and correspondingly there is no reaction moment on the periphery of the inclined disk of an inclined-disk axial piston motor. Any one of these moments or lack of moments or absence of torque can be sensed to control the application of the break-loose force. For example, if there is no torque or tangential force on the disk, in spite of the fact that operating pressure has been applied to the motor, the break-loose movement can be triggered.

The above described systems have been found to be considerably more effective and less costly than arrangements in which one or more auxiliary cylinders tangential to the motor shaft are provided to "kick" the motor into operation.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
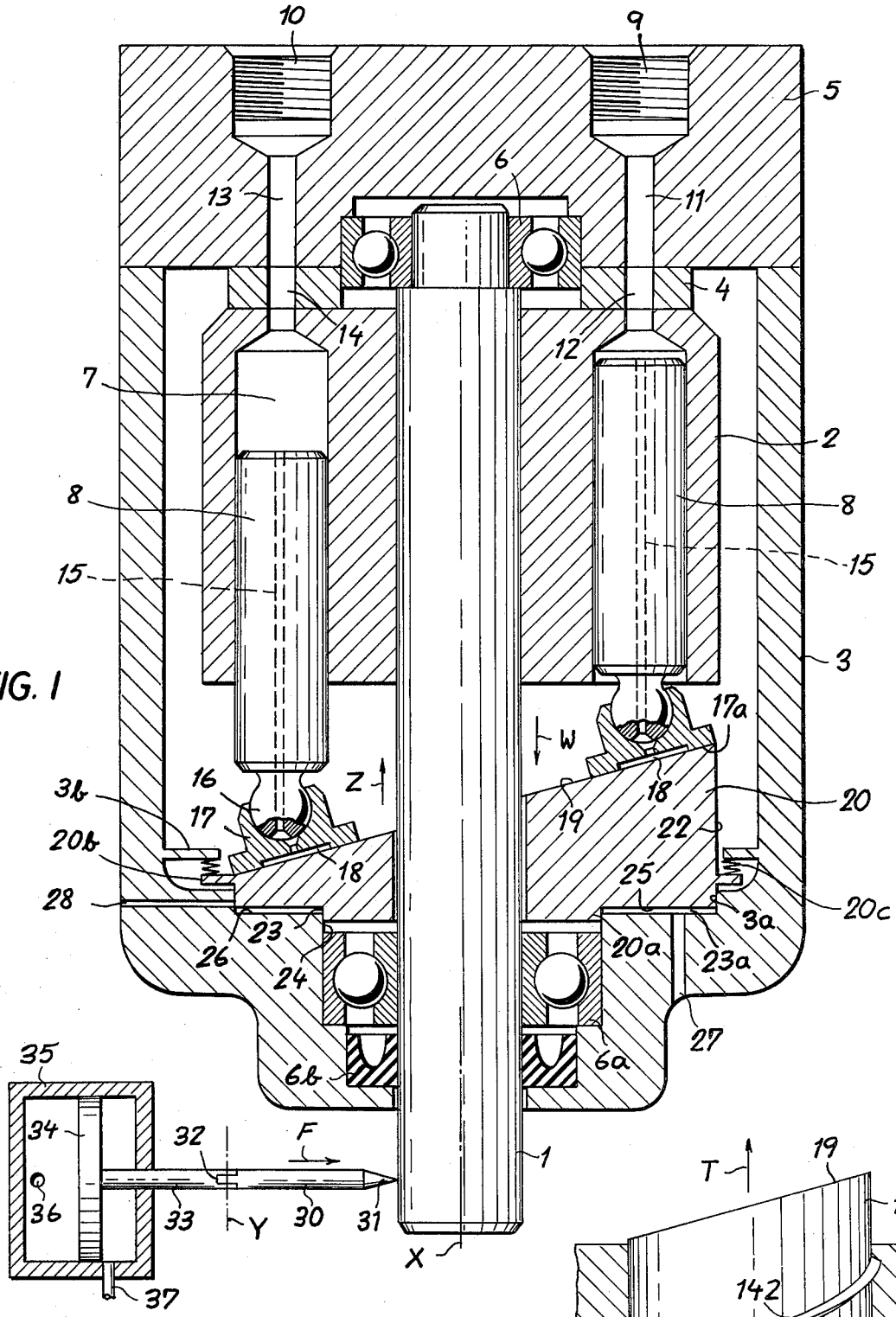
FIG. 1 is an axial cross-sectional view diagrammatically illustrating an inclined disk axial piston motor according to the invention.

In FIG. 1 of the drawing, I show an axial piston motor which has a shaft 1 fixed to a cylinder drum 2 the top of which rides upon a valve plate 4 formed with the orifices 12 and 14 which communicate with the respective cylinders 7 of the drum 2. The plate 4 rests against the top 5 of the housing in which the shaft 1 is journaled in ball bearings 6 in accordance with conventional axial-piston motor practice.

Each of the cylinders 7, angularly spaced around the axis of the shaft in the drum 2 and having respective axes parallel to the axis of the shaft, receives a rectilinearly slidable piston 8. Connecting fittings 9 and 10 can be tied to a supply system for the drive fluid and are formed in the top 5 of the housing, being connected by passages 11 and 13 to the respective orifices 12 and 14 of the plate 4. When hydraulic fluid is applied to one of these fittings 9 or 10 under pressure and a pressure differential between the two fittings is established the cylinder drum 2 rotates thereby entraining the shaft 1 and operating a load.

Each of the pistons 8 is formed with a longitudinal bore 15 opening at a ball head 16 received in a socket of a slide shoe 17 which defines with an inclined surface 19 a pressurizable chamber or cushion space 18 connected with the passage 15 so that the supply of fluid under pressure to any cylinder 7 will result in communication of the fluid to the cushion space 18, thereby generating a lubricating film along the sliding track of the shoe 17.

As noted, the shoes 17 slide along an inclined surface 19 of the inclined disk formed by a body 20 which is axially displaceable in the housing 3 but is keyed thereto so that rotation is prevented.

The body 20 has a cylindrical periphery 22 received in a cylindrical recess **3*a* sealingly in the housing 3 and a neck 20*a* with a cylindrical wall 23 received in a cylindrical bore 24 of the housing which can receive another bearing 6*a* and a seal 6*b***.

The surface 25 of body 20 normally rests against the opposing wall 26 of the housing 21. The annular surfaces 25 and 26, the wall of recess **3*a* and the cylindrical surface 23 form a pressurizable compartment 23***a* which can be supplied with pressure via a bore 27 in the housing 3.

As will be apparent hereinafter, the higher pressure of either fitting 9 or 10 is delivered to the bore 27 so that the body 20 is driven axially in the direction of the arrow Z until the surface 25 clears a radial bore 28 through which the fluid is discharged.

As will also be apparent hereinafter, the discharge of fluid through passage 28 can operate a valve closing the fluid flow to bore 27 and drain the latter to a reservoir or to the intake side of a pump.

A sensing pin 30 has a point 31 which bears against the shaft 1 and is connected by a hinge 32 with the piston rod 33 of a rotation sensor. The axis of hinge 32, represented at Y is parallel to and coplanar with the axis X of the shaft 1 so that the pin 30, in the rest position of the shaft, lies precisely along a radius of the shaft.

The piston rod 33 is carried by a piston 34 displaceable in a cylinder 35 to which hydraulic fluid can be delivered via inlet 36. The outlet from the cylinder 35 is shown at 37.

When the cylinder 35 is pressurized behind the piston 34 and the shaft 1 is at standstill, the pin 30 bears with its tip 31 upon the surface of shaft 1 and the piston 34 is immobile. However, should the shaft 1 begin to rotate in either direction (see FIGS. 3 and 4 and the description thereof below), the pin 30 is swung about the axis 32 and the piston 34, freely to move in the direction of arrow F to clear the outlet 37 and permit fluid to drain from the cylinder. The device 30–37 thus constitutes a detector for the rotational movement of the shaft.

The system illustrated in FIG. 1 operates as follows:

When hydraulic fluid is supplied to one of the connections 9 or 10 at an elevated pressure while the other connection is at a reduced pressure and the pressure supplied exceeds a predetermined threshold which can be a certain percentage of the maximum operating pressure, the sensor 30–37 is pressurized and the pin urged against the shaft 1. If the shaft 1 is not rotating, the pressure buildup in the cylinder 35 operates a valve to connect bore 27 to the pressure side of the pump or the connection 9 or 10 at the higher pressure and body 20 is shifted in the direction of arrow Z until the surface 25 clears the bore 28. The hydraulic fluid flow through this bore 28 operates a valve to drain bore 27 and chamber 23*a* so that this body 20 can return in the direction of arrow W.

The displacement of body 20 in the direction of arrow Z causes the pistons 8 to slide slightly relative to the walls of their respective cylinders 7 thereby breaking the static friction between them. The sharp return of the body 20 in the opposite direction W lifts the surface 19 slightly from the shoes 17 so that fluid can flow from the cushions 18 beneath the sealing surfaces 17*a* of these shoes to break the static friction along the sliding track of the shoes and the motor is thereby driven. The spring washer 20*a* mounted on a flange 20*b* of the periphery of body 20 can engage another flange 3*b* of the housing 3 to drive the body 20 in the direction of arrow W sharply so as to assist in lifting the surface 20 away from the shoes 17. During operation this spring or hydraulic means can hold the body 20 against the pistons.

Figure 2:
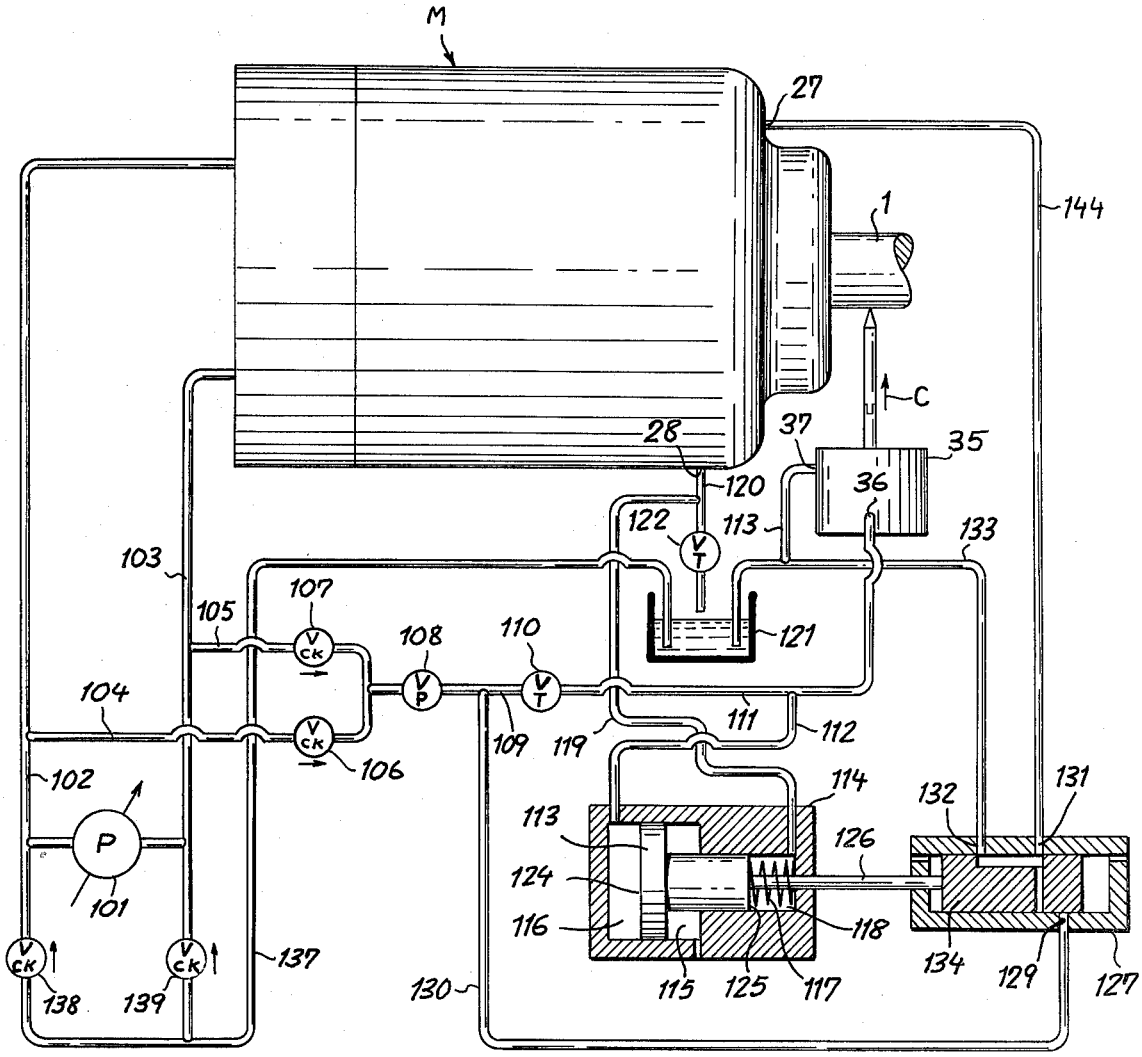
FIG. 2 is a diagram of a hydraulic system for use with the motor of FIG. 1.

In FIG. 2 of the drawing I have shown the motor M which has been described in detail in connection with FIG. 1 and which is supplied with hydraulic fluid via lines 102 and 103 from the variable-stroke axial-piston pump 101 which can be reversed to reverse the direction of flow of the fluid and thereby reverse the motor. Branches 104 and 105 from lines 102 and 103 are each provided with a respective check valve 106, 107 and feed a pressure-threshold valve 108 which opens when the applied pressure exceeds a predetermined minimum value.

A line 109 runs from the threshold valve 108 to the inlet 36 of the rotation detector 35 and is provided with a throttle valve 110. The stretch 111 between the throttle valve 110 and the inlet 36 is branched at 112 to a hydraulic comparator represented generally at 114.

From the outlet 37 of the rotation detector 35 a line 113 runs to the reservoir 121 which supplies hydraulic fluid, as required, through either of the check valves 138 and 139 via a line 137 to feed the pump 101.

Another line 130 from the pressure threshold valve 108 runs to an inlet port 129 of a control valve 127 whose control member 126 is connected to the piston 123 of the hydraulic comparator.

The hydraulic comparator 114 is formed with a compartment 116 in which the piston 113 has a large effective surface area 124. The opposite small effective surface area 115 of the piston, upon which a spring 117 acts, is exposed to hydraulic pressure in a chamber 118 into which the line 119 opens. The compartment 115 is vented. The line 112 connected to compartment 116 runs from line 111 while the line 119 leads from an outlet 120 communicating with the passage 28 ahead of a throttle valve 122 through which this passage discharges fluid into the reservoir 121.

One port 131 of the valve 127 is connected via a line 144 to the inlet 27 of the motor while another port 132 is connected via line 133 to the reservoir 121. The valve body 134 has two positions. In one of these positions, shown in FIG. 2, lines 130 and 144 are disconnected and line 144 is connected to line 133 to drain the compartment 26 behind the body 20 carrying the inclined surface.

Figure 3:
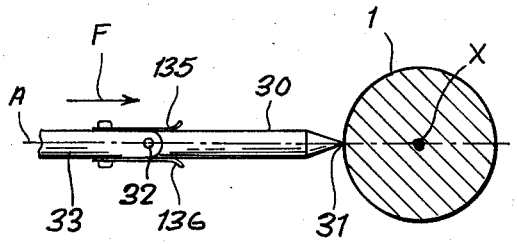
FIG. 3 is a detail view showing the cooperation of the rotation detector with the shaft, in one position of the rotation detector.
Figure 4:
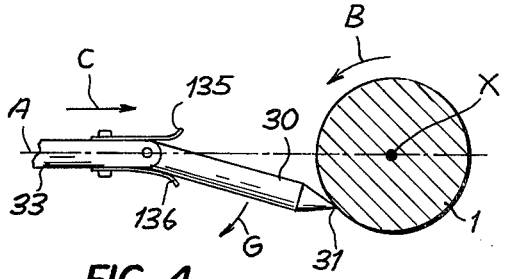
FIG. 4 is a view similar to FIG. 3 with the rotation detector in another position.

The rotation detector comprises, as has been illustrated in FIG. 3, the hinge 32 between members 33 and 30, the latter being provided with the point 31. The axis of hinge 32 lies in the same plane A as the axis D of the shaft 1 and is parallel thereto. Thus, when a force is provided in the direction of arrow F, the point 31 bears at a diameter against the shaft in the plane A and is immobilized by the nonrotating shaft. A pair of leaf springs 135 and 136 can be used as shown in FIG. 3, to restore the point 31 to its normal position in the plane A.

When, however, a rotation is imparted to shaft 1, say in the direction of arrow B (counterclockwise sense in FIG. 4), the point 31 is deflected in the counterclockwise sense (G) and member 33 is free to move in the direction of arrow C under the force supplied to the piston 34.

Assume, with the system of FIGS. 1 through 4, that the pump 101 applies high pressure at line 102 and the shaft 1 is immobile, indicating that static friction is retarding rotation of the motor. The dominating pressure is applied by a check valve 106 to the pressure threshold valve 108 and, since the pressure is in the range of the high operating pressures of the motor opens this valve 108 and delivers fluid via the throttle 110 to the rotation detector 35 behind the piston 34 thereof. The force F is thereby applied but member 33 is not free to move because the shaft 1 is at standstill. A corresponding pressure is applied via line 112 to chamber 116 and builds up therein to shift valve member 134 to the right. Thus the pressure is applied via line 130 through the valve 127 and line 144 to the compartment 26 of the motor to displace the body 20 carrying the inclined surface 19 axially until hydraulic fluid flows through the passage 28 and then via line 120 to the reservoir 121. The pressure buildup behind the throttle 122 is delivered via line 119 to chamber 118 and is effective to shift the valve 134 into the position shown in FIG. 2 in which flow of fluid to line 144 is terminated and the chamber 261 drained suddenly. The sharp rearward movement of the body 20 allows fluid to pass beneath the foot 17 from the pressurized compartment 18.

The reduction in static friction permits the shaft 1 to rotate, thereby deflecting member 31 and allowing the stem 33 of the piston 34 to move in the direction of arrow C, draining the rotation detector 35 through the port 37 and line 113. The pressure in chamber 116 is thereupon reduced and the spring 117 retains valve member 134 in its position shown.

Of course, if the motor immediately starts, any buildup of pressure in line 111 freely displaces the piston 34 and prevents the development of a pressure in line 112 which could shift the valve member 134 and the starting system remains inoperative.

Figure 5:
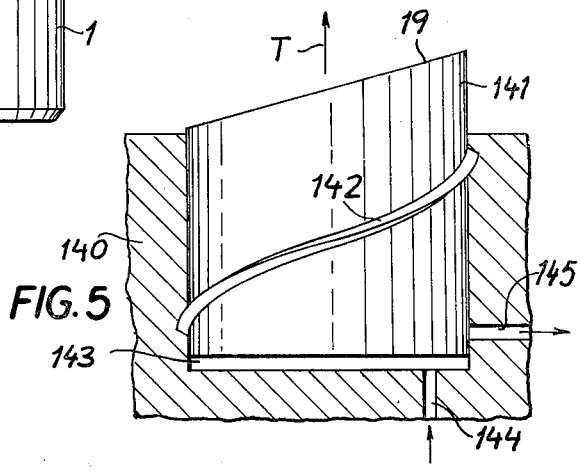
FIG. 5 is a diagrammatic view of another system for displacing the body carrying the inclined surface according to the invention.

Another system has been shown in FIG. 5 in which the body 141 forming the inclined surface 19 is provided with a screw thread 142 so that pressurization of chamber 143 displaces the body 141 both angularly and axially in the direction of arrow T until the port 145 in the housing 140 is cleared. The thread can be self-blocking in the reverse direction until the pressure in chamber 143 is relieved.

I claim:

1. A hydraulic piston motor comprising a shaft; cylinder means operatively connected with said shaft and forming at least one cylinder; a piston hydraulically reciprocable in said cylinder for rotating said shaft; and temporarily effective start-promoting means effective upon hydraulic pressurization of said cylinder prior to rotation of said shaft to impart to a member acting upon said piston and thereby to said piston an initial relative movement between said piston and said cylinder to break adhesive static friction therebetween and thereby decrease the friction retarding starting displacement of said piston.

2. The motor defined in claim 1 wherein at least a component of said relative movement is applied parallel to the axis of said piston.

3. The motor defined in claim 1 wherein at least a component of the relative movement is applied tangential to the path of said piston.

4. The motor defined in claim 1, further comprising a torque sensor operable upon the application of drive pressure to the motor above a predetermined threshold for initiating said relative movement in the absence of rotation of a load.

5. A hydraulic piston motor comprising a shaft; cylinder means operatively connected with said shaft and forming at least one cylinder; a piston hydraulically reciprocable in said cylinder for rotating said shaft; means effective upon hydraulic pressurization of said cylinder prior to rotation of said shaft to impart to a member acting upon said piston and thereby to said piston an initial relative movement between said piston and said cylinder to break adhesive static friction therebetween and thereby decrease the friction retarding starting displacement of said piston; and rotation sensing means effective upon hydraulic pressurization of said motor under standstill of said shaft for initiating said relative movement.

6. The motor defined in claim 5 wherein said sensing means comprises a hydraulic cylinder having a piston, a sensing pin hinged on said piston for tilting about an axis parallel to the axis of said shaft and bearing thereon, whereby upon deflection of said pin relative to said piston, said sensor signals rotation of said shaft.

7. An axial-piston motor system comprising:

a housing;

a cylinder drum rotatable in said housing and formed with a plurality of annularly spaced cylinder bores and respective pistons reciprocable within said bores;

a body formed with an inclined surface bearing against said pistons;

a shaft operatively connected with said cylinder drum for rotation upon hydraulic pressurization of said cylinder bores to displace said pistons; and temporarily effective start promoting means for axially displacing said body upon the development of a pressure at said bores sufficient to rotate said drum in the absence of static friction between said pistons and the walls of said bores for breaking said static friction.

8. The axial-piston motor system defined in claim 7 wherein said pistons have heads riding on said surface, said means including mechanism for temporarily lifting said surface away from said heads.

9. The axial-piston motor system defined in claim 7 wherein said pistons are formed with slide shoes riding on said surface and defining pressurizable compartments therewith and with passages communicating between said cylinder bores and said compartments, said means including mechanism for temporarily lifting said surface away from said shoes.

10. The axial-piston motor system defined in claim 9 wherein said means includes a chamber formed between said housing and said body and provided with an inlet and an outlet, means for delivering hydraulic fluid to said inlet upon pressurization of said cylinder bores.

11. The axial-piston motor system defined in claim 10 wherein said motor has a pair of connections selectively pressurizable to drive said motor in a respective sense, and means for communicating fluid flow from the one of the connection having the higher pressure to said inlet.

12. The axial-piston motor system defined in claim 10 wherein the last-mentioned means includes a valve, said system further comprising a rotation detector for controlling said valve, said rotation detector comprising a cylinder having a sensor piston, a pin hinged to said sensor piston for swinging movement about an axis parallel to the axis of said shaft whereby said pin bears upon said shaft radially upon pressurization of said cylinder in the absence of rotation of said shaft; and means connected to said valve and said sensor and hydraulically responsive to movement of the pistons of said sensor for operating said valve.

13. The axial-piston motor system defined in claim 10 wherein said outlet is cleared by said body upon such movement thereof by pressurization of said chamber to drain fluid therefrom, said axial-displacement means further including means responsive to the drained fluid for terminating fluid flow to said inlet.

14. An axial-piston motor system comprising:

a housing;

a cylinder drum rotatable in said housing and formed with a plurality of annularly spaced cylinder bores and respective pistons reciprocable within said bores;

a body formed with an inclined surface bearing against said pistons;

a shaft operatively connected with said cylinder drum for rotation upon hydraulic pressurization of said cylinder bores to displace said piston; and temporarily effective start-promoting means for axially displacing said body upon the development of a pressure at said bores sufficient to rotate said drum in the absence of static friction between said pistons and said body for breaking said static friction.

15. The axial-piston motor system defined in claim 14 wherein said pistons have heads riding on said surface, said means including mechanism for temporarily lifting said surface away from said heads.

16. An axial-piston motor system comprising:

a housing;

a cylinder drum rotatable in said housing and formed with a plurality of annularly spaced cylinder bores and respective pistons reciprocable within said bores;

a body formed with an inclined surface bearing against said pistons;

a shaft operatively connected with said cylinder drum for rotation upon hydraulic pressurization of said cylinder bores to displace said piston; and temporarily effective start-promoting means for axially displacing said drum upon the development of a pressure at said bores sufficient to rotate said drum in the absence of static friction between said pistons and the walls of said bores for breaking said static friction.

17. An axial-piston motor system comprising:

a housing;

a cylinder drum rotatable in said housing and formed with a plurality of annularly spaced cylinder bores and respective pistons reciprocable within said bores;

a body formed with an inclined surface bearing against said pistons;

a shaft operatively connected with said cylinder drum for rotation upon hydraulic pressurization of said cylinder bores to displace said piston; and an auxiliary piston tangential to said shaft effective with lost motion against the force of a spring and actuated upon the development of a pressure at said bores sufficient to rotate said drum in the absence of static friction between said pistons and the walls of said bores for engaging said shaft to initiate rotation thereof and break said static friction.

* * * * *